US006990210B2

(12) United States Patent
Cheng

(10) Patent No.: US 6,990,210 B2
(45) Date of Patent: Jan. 24, 2006

(54) SYSTEM FOR HEADPHONE-LIKE REAR CHANNEL SPEAKER AND THE METHOD OF THE SAME

(75) Inventor: Eric Cheng, Taipei (TW)

(73) Assignee: C-Media Electronics, Inc., Taipei (TW)

( * ) Notice: Subject to any disclaimer, the term of this patent is extended or adjusted under 35 U.S.C. 154(b) by 543 days.

(21) Appl. No.: 09/996,016

(22) Filed: Nov. 28, 2001

(65) Prior Publication Data

US 2003/0099369 A1 May 29, 2003

(51) Int. Cl.
*H04R 5/02* (2006.01)
*H04R 5/00* (2006.01)
*H04R 1/10* (2006.01)

(52) U.S. Cl. ..... 381/309; 381/74; 381/300; 381/17

(58) Field of Classification Search ..... 381/17–19, 381/74, 182, 184, 307–311
See application file for complete search history.

(56) References Cited

U.S. PATENT DOCUMENTS

| | | | | |
|---|---|---|---|---|
| 6,144,747 | A * | 11/2000 | Scofield et al. | 381/309 |
| 6,356,644 | B1 * | 3/2002 | Pollak | 381/371 |
| 2003/0099369 | A1 | 5/2003 | Cheng | |
| 2003/0103637 | A1 * | 6/2003 | Huang | 381/309 |
| 2003/0108216 | A1 | 6/2003 | Cheng | |
| 2005/0041816 | A1 * | 2/2005 | Cheng | 381/26 |

* cited by examiner

*Primary Examiner*—Laura A. Grier
(74) *Attorney, Agent, or Firm*—Perkins Coie LLP

(57) ABSTRACT

A method of performing sound effect comprising providing a headphone-like or earphone-like device with rear speakers carried therein, wherein the headphone-like or earphone-like device includes an opening for receiving the front speaker signal. Then, the signal is transmitted to the front, rear and sub-woofer signal to associated speakers. The signal to the rear speakers is processed by HRTF and means for creating virtual speakers to obtain virtual speakers of the rear side. The processed signal is transmitted to the rear speaker.

2 Claims, 2 Drawing Sheets

SYSTEM FOR HEADPHONE-LIKE REAR CHANNEL SPEAKER AND THE METHOD OF THE SAME

FIELD OF THE INVENTION

The present invention relates to a system for digital sound effect, and more specifically, to a method and system for home theater, the system allows the rear sound effect to be performed by an earphone-like or headphone-like rear channel speaker.

BACKGROUND OF THE INVENTION

Along with the rapid development of electronic industry, it is not uncommon to play sound effect with advance sound and visual effects on computers anymore. Therefore, the requirement for video and audio performance has become more and more stringent. Except for the need of higher resolution and visual quality, in the field of audio frequency and sound effect, multi-channel sound effect has gradually replaced stereo sound effect and the mono sound effect. In an attempt to provide a more realistic or engulfing listening experience in the home theater, several techniques have developed multi-channel audio formats. Each audio channel of the multi-channel signal is routed to one of several speakers distributed throughout the home theater, providing the sound effect with the sensation that sounds are originating all around them. As the home entertainment system market expands, other multi-channel systems will likely become available to home consumers. Humans are able to localize a sound to the right or left based on arrival time and sound level differences discerned by each ear.

Head related transfer functions (HRTFS) are used to simulate positional and virtual images three-dimensional (3-D) sound using fixed speaker locations. The shape of the human head, body and auditory system affect how the brain perceives the position of sound sources. An HRTF is a characterization of the human head, body and auditory system. Thus, the HRTF is affected by the size and shape of the head, the size and shape of the pinnae, the characteristics of the ear canal. The HRTF is typically a function of both frequency and relative orientation between the head and the source of the sound field. The HRTF accounts for the frequency response, frequency filtering, delays and reflections inherent in the human head. By adjusting the frequency and delays of audio signals according to the HRTF, three-dimensional sound can be simulated from fixed speaker locations. U.S. Pat. No. 5,729,612 entitled "Method and apparatus for measuring head-related transfer functions", which disclosed a method for accurately deriving acoustic transfer functions such as head-related transfer functions at low cost. The prior art is filed on Aug. 5, 1994.

A unique HRTF can be calculated for each individual by performing detailed and time-consuming measurements of the head, ear and body. The measurements taken for an individual are converted to a transfer function usable by a processing device to adjust the characteristics of audio signal outputs to individual earphones to simulate positional three-dimensional sound.

Because HRTF simulates the sound effect model heard by a human ear in a three-dimensional space and the parameters corresponding to the three-dimensional sound effect at every spot of the space are determined by its distance, azimuth, and elevation, the listener feel like within the real atmosphere of the sound while playing the sound effect. The Head Related Transfer Function uses an artificial head or put microphones within human ears. Each sound source has to be measured from 20 HZ~20 KHZ and the result is preliminary HRTF library. The preliminary HRTF library, via mathematical process, generates parameters needed by DSP digital filter. As long as mono wave sound is processed by the left and the right digital filters, it can emulate 3D positional audio by means of earphones.

HRTF 3D Positional Audio in PC Applications includes simulating multi-speaker Surround with two physical speakers to deliver five "virtual speakers" into space surrounding the listener and enabling home theater sound effects. However, the 5.1 CH DVD or 4 CH 3D game uses HRTF to create virtual speakers on rear side to replace physical speaker for DVD and 3D game meets some problems. The ear-phone device do not have the ability to offer good bass. The bass wavelength is longer than the size of human head, thus there is no direct information on bass due to the structure of the earphone device. Bass speaker called sub-woofer speaker is good for all channels. It is unfortunately, the rear side bass has to be filtered out from rear signal.

There is a great need for sound control system to overcome the difficulties mentioned above.

SUMMARY OF THE INVENTION

The object of the present invention is to disclose a control system for sound effect system.

The further object of the present invention is to provide a system for earphone-like rear speakers.

A method of performing sound effect comprising providing a headphone-like or earphone-like structure with rear speakers carried therein, wherein the headphone-like or earphone-like device includes an opening for receiving the front speaker signal. Then, the signal is transmitted to the front, rear and sub-woofer signal to associated speakers. The signal to the rear speakers is delay according to the distance between a user and a front speaker. Then, the signal is processed by HRTF and means for creating virtual speaker to create the virtual speakers of rear side. The processed signal is transmitted to the headphone-like device.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

THE DETAILED DESCRIPTION OF THE PREFERRED EMBODIMENT

Figure 1:
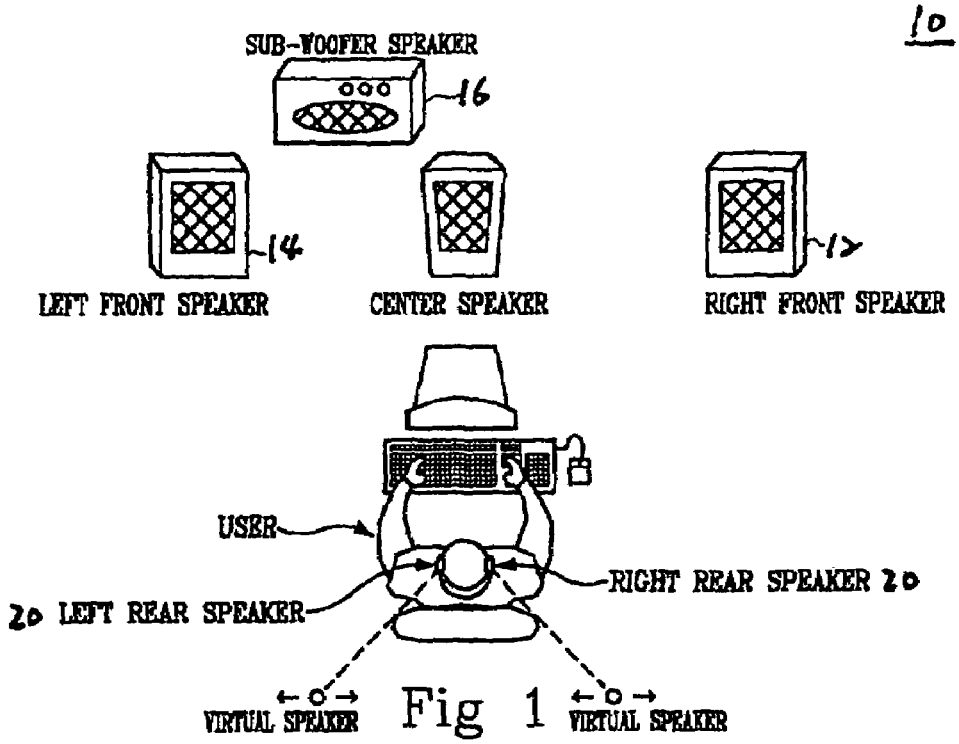
FIG. 1 is scheme illustrating a 5.1 D home theater sound effect system according to the present invention.

Turning to FIG. 1, it illustrates the home theater 5.1D sound effect system 10, the system 10 includes front right 12, front left 14, sub-woofer speakers 16 and rear right, rear left speakers 20. One of the aspects of the present invention is that the rear right, rear left speakers are constructed by an earphone-like or headphone-like device or structure. The feature of the present invention focus on the rear speakers and the control system. It has to be noted that the rear speakers are consisted in the earphone-like structure for user to carry on one's head instead of positing on a certain locations to create the virtual speakers of rear side. The earphone-like or headphone-like structure cannot cover the whole ear for receiving the sound from the front speakers and sub-woofer speaker. Thus, there is opening structure to allow the ears to listen the sound from the front speakers. The rear right and rear left speakers are respectively located on both sides of the earphone-like or headphone-like structure to create the virtual speakers of rear side sound effect.

Figure 2:
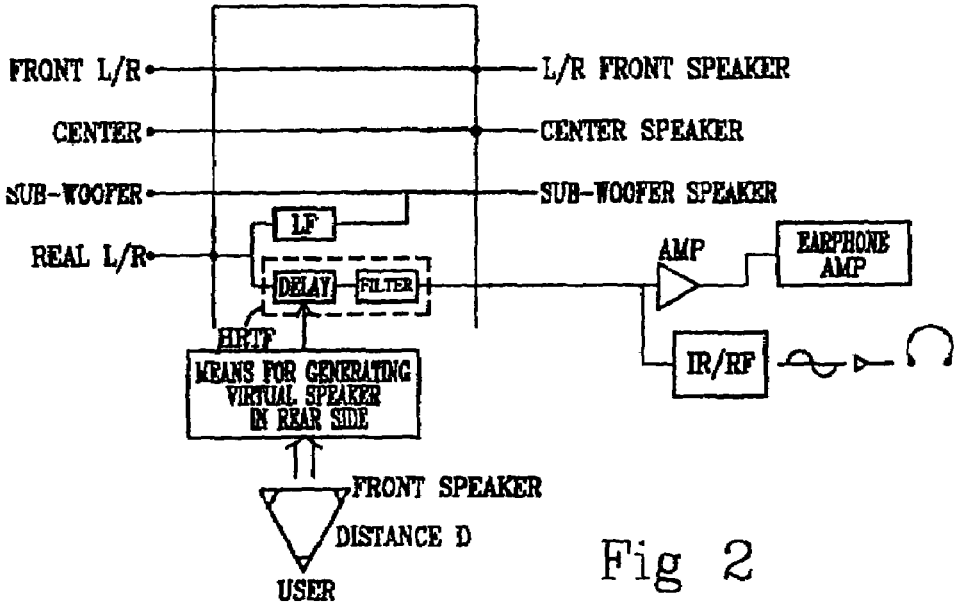
FIG. 2 is the system with headphone-like structure according to the present invention.

Please turn to FIG. 2, the front channel signal is fed to the front right and left speakers and the center channel signal is also fed to the center speaker via transmission lines. Similarly, the sub-woofer channel signal is also input to the sub-woofer speaker.

A low pass filter (LF) is coupled to the rear right and left signal to filter out the high frequency signal and the low frequency will pass the filter and be sent to the sub-woofer speaker speakers. The means for generating HRTF is coupled to the rear right and left signal to simulates the virtual speakers of the rear side. The HRTF includes means for delaying signal and filters. The means for generating HRTF can be implanted by using hardware or software.

Means for delaying signal is coupled to the rear right and left signal to delay the signal that transmitted to the rear right and left speaker carried by the earphone-like or headphone-like structure. It is because that the distant of the rear right and left speaker to the ear is closer than the distant of other speakers. Thus, means for generating virtual speaker in rear side is connected to the means for generating HRTF to set the delay time according to the distance D between the user and the front speaker. The function of the means for generating virtual speaker can be achieved by using hardware or software. Typically, the delay time is approximately D/velocity of sound in the air. The delay signal is processed by HRTF and fed to the volume controller for adjusting the output volume. HRTF simulates the sound effect model heard by a human ear in a three-dimensional space and the parameters corresponding to the three-dimensional sound effect at every spot of the space are determined by its distance, azimuth, and elevation.

Then, the signal is fed to an amplified therefore output by the rear speakers carried by earphone-like or headphone-like structure. The signal performed by the rear speakers is delay and therefore the ear may receive the signal from the rear speaker and front speaker at the same time. Alternatively, the signal under transmitting to the rear speaker may be emitted by IR or RF. Thus, the earphone-like or headphone-like structure needs the receiver to receive the wireless transmission signal.

Figure 3:
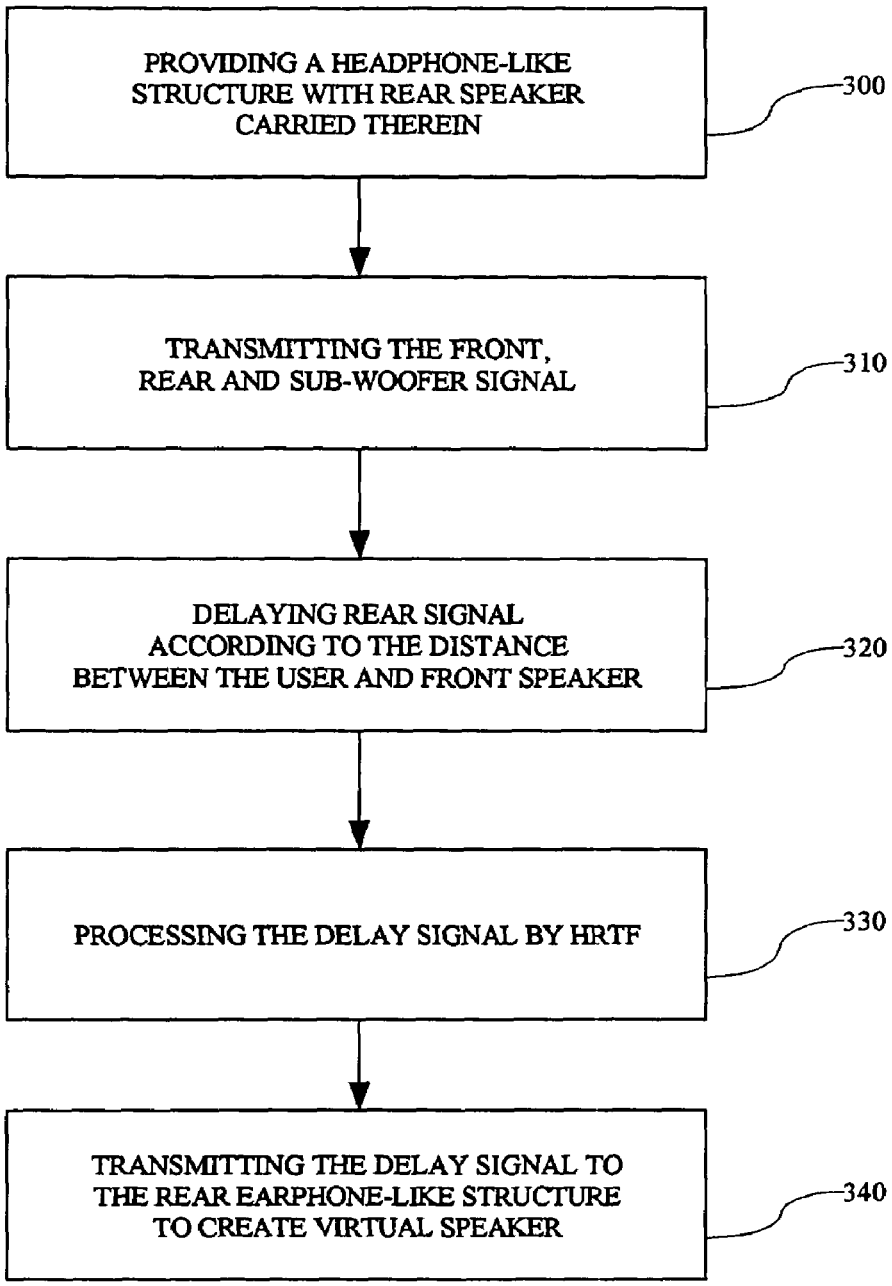
FIG. 3 illustrates the flow chart of the present invention.

FIG. 3 illustrates the procedure according to the present invention. In step 300, the present invention provides a headphone-like or earphone-like structure with rear speaker carried therein. The headphone-like or earphone-like structure also includes an opening for receiving the front speaker signal. Next, step 310, the sound effect system transmits the front, rear and sub-woofer signal to the associated speakers. The signal under transmitting to the rear speakers is delay according to the distance between the user and the front speaker in step 320. The signal is processed by means for generating head-related transfer function (HRTF) in step 330. Then, in step 340, the signal is transmitted to the headphone-like structure to create the virtual speaker of the rear side.

The present invention provides a headphone-like or earphone-like structure for the user to carry on one's head. The headphone-like or earphone-like structure includes the rear speakers carried therein. The headphone-like or earphone-like structure also includes an opening for receiving the front speaker signal. The present invention provides better sound effect without losing the bass for the rear side.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure. While the preferred embodiment of the invention has been illustrated and described, it will be appreciated that various changes can be made therein without departing from the spirit and scope of the invention.

What is claimed is:

1. A method of performing sound effect comprising: providing a headphone or earphone device with rear speakers carried therein, wherein said headphone or earphone device includes an opening for receiving the front speaker signal signals from a front speaker; transmitting front, rear and sub-woofer signal signals to associated speakers; wherein, the front speakers and subwoofer speaker are remotely located from the headphone or earphone device; processing and delaying the signal under transmitting rear signals transmitted to rear speakers by head-related transfer function (HRTF) according to the distance between a user and a front speaker; and transmitting said processed signal signals to said rear speaker speakers to create virtual speakers of the rear side without losing the rear side bass basses.

2. The method of claim 1, wherein a delay time of said delay signal is determined by a distance between said user and said front speakers divided by the velocity of the sound in air.

* * * * *